US007043954B2

(12) United States Patent
Broady

(10) Patent No.: US 7,043,954 B2
(45) Date of Patent: May 16, 2006

(54) APPARATUS FOR STRAIGHTENING A PROPELLER DRIVE SHAFT

(76) Inventor: Loren Broady, 1 Jill Rd., Salem, NH (US) 03079

( * ) Notice: Subject to any disclaimer, the term of this patent is extended or adjusted under 35 U.S.C. 154(b) by 9 days.

(21) Appl. No.: 10/814,385

(22) Filed: Mar. 31, 2004

(65) Prior Publication Data

US 2005/0217341 A1 Oct. 6, 2005

(51) Int. Cl.
*B21D 7/06* (2006.01)
*B21D 53/84* (2006.01)

(52) U.S. Cl. ..... 72/311; 72/305; 29/252; 29/283.5

(58) Field of Classification Search ..... 72/305, 72/311, 308, 479, 705; 29/252, 283.5
See application file for complete search history.

(56) References Cited

U.S. PATENT DOCUMENTS 1,037,301 A * 9/1912 Paine ..... 72/305
2,310,151 A 2/1943 Pope
2,596,976 A * 5/1952 Barber ..... 72/308
2,827,943 A * 3/1958 Judge, Jr. ..... 72/18.1
3,028,905 A 4/1962 Dirks
3,074,463 A 1/1963 Leighter
3,581,537 A 6/1971 Lance
3,965,714 A 6/1976 Beard
4,014,196 A 3/1977 Ogren
4,061,006 A 12/1977 Burns, Jr.
4,876,877 A * 10/1989 White ..... 72/388
5,428,979 A * 7/1995 Knipp et al. ..... 72/31.04

* cited by examiner

*Primary Examiner*—Daniel C. Crane
(74) *Attorney, Agent, or Firm*—Thomas P. Grodt

(57) ABSTRACT

An apparatus and method for straightening propeller drive shafts without the need for removing the shaft from the lower unit/drive assembly is disclosed. In an embodiment of the present invention, a mechanical linkage is provided that is configured to securely grip the propeller drive shaft and that is mechanically coupled to an extension module. The extension module may be a hydraulic ram that provides a linear force. The linkage is configured to receive the linear force from the extension module and transfer the linear force to the propeller drive shaft. Because the propeller drive shaft is securely fixed within the linkage and within the lower unit/drive assembly, the force applied to the propeller drive shaft is operative to bend the propeller drive shaft opposite of the existing bend in order to straighten it.

15 Claims, 2 Drawing Sheets

APPARATUS FOR STRAIGHTENING A PROPELLER DRIVE SHAFT

BACKGROUND OF THE INVENTION

1. Field of the Invention

This invention generally relates to an apparatus for straightening drive shafts and in particular, to an apparatus for straightening a propeller drive shaft while still attached to the boat lower unit/drive assembly.

2. Description of Related Art

Powerboats, whether they are inboard or outboard, are susceptible to having a propeller drive shaft bent when the propeller strikes an object submerged in the water, such as a rock or log. After such an accident to avoid further damaging the lower unit/drive assembly, the propeller drive shaft must be repaired or replaced. Whether the propeller drive shaft is to be repaired or replaced, the propeller drive shaft is typically removed from the lower unit/drive assembly. As used herein, the lower unit/drive assembly is the portion of a boat lower unit/drive assembly, whether an outboard or stern drive that includes the propeller shaft and gear case.

Removing the propeller drive shaft from the lower unit/drive assembly is not a trivial undertaking, and the labor involved with the removal of the damaged shaft and the installation of the new or repaired shaft is significant. Typically, a large percentage of the cost and time associated with either replacement or repair of the propeller drive shaft is associated with the labor involved in removing and installing it. Although the actual straightening of a propeller drive shaft is not difficult, it does require a machine shop having a suitable press. In general, it is cheaper to repair a propeller drive shaft than replace it, but both alternatives are still quite expensive and time consuming.

Accordingly, it would be advantageous to provide an apparatus that could reduce the time and cost associated with the repair or replacement of a propeller drive shaft in a motorboat.

SUMMARY OF THE INVENTION

An apparatus and method for straightening a propeller drive shaft without the need for removing the shaft from the lower unit/drive assembly is disclosed. In an embodiment of the present invention, a mechanical linkage is provided that is configured to securely grip the propeller drive shaft and is also coupled to an extension module, such as a hydraulic piston, that provides a linear force. The linkage is configured to transfer the linear force to the propeller drive shaft in a predetermined direction. Because the propeller drive shaft is securely fixed both within the linkage and within the lower unit/drive assembly, the force applied to the propeller drive shaft is operative to bend the propeller drive shaft. For a propeller drive shaft that is gripped in the proper orientation, the force provided by the linkage should be in the opposite direction of the existing bend in order to straighten it.

In an embodiment of the present invention, the linkage includes a link member, a headpiece that is coupled to one end of the link member, and a footpiece coupled to the link member spaced apart from the headpiece. The headpiece is configured to form an opening that is defined by the bottom and side surfaces of the headpiece and the upper surface of the link member. The opening is sized to receive the propeller drive shaft. The top surface of the link member and the bottom surface of the headpiece form a pair of gripping surfaces that are operative to securely hold the propeller drive shaft in a desired orientation. In addition, the force applied to the propeller drive shaft will be transferred via the gripping surfaces. The gripping surfaces are configured so that the force applied to the propeller drive shaft is substantially parallel to the longitudinal axis of the link member.

In order to properly orient the propeller drive shaft such that the applied force results in a reduction of the bend in the propeller drive shaft, a dial indicator is employed to detect the variations in the circumference of the propeller drive shaft. The dial indicator is placed at the lowest portion of the propeller drive shaft to sense the variations in the circumference at this point. When the largest variation in circumference is found, the propeller drive shaft is inserted and secured between the two gripping surfaces. In this way, the vertically applied force is operative to bend the propeller drive shaft in a direction opposite to the existing bend. During operation of the extension module, the dial indicator is removed during application of the straightening force and then used again to provide visual feedback of the condition of the propeller drive shaft.

Other features, aspects, and advantages of the above-described method and system will be apparent from the detailed description of the invention that follows.

BRIEF DESCRIPTION OF THE DRAWINGS

Aspects of the present invention are pointed out with particularity in the appended claims. The present invention is illustrated by way of example in the following drawings in which like references indicate similar elements. The following drawings disclose various embodiments of the present invention for purposes of illustration only and are not intended to limit the scope of the invention. For purposes of clarity, not every component may be labeled in every figure. In the figures:

DETAILED DESCRIPTION

Figure 1:
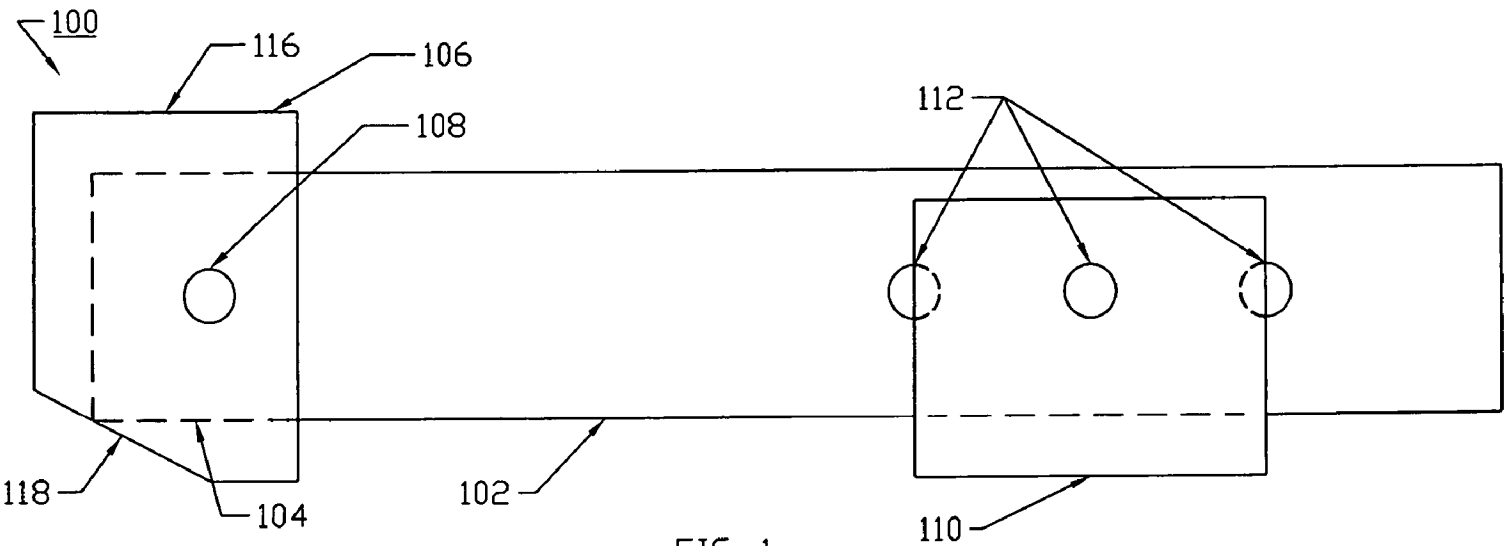
FIG. 1 is a side view of an embodiment of the linkage of the present invention.

The following detailed description sets forth numerous specific details to provide a thorough understanding of the invention. However, those skilled in the art will appreciate that the invention may be practiced without these specific details. In other instances, well-known methods, procedures, components, protocols, algorithms, and circuits have not been describe in detail so as not to obscure the invention.

An embodiment of the present invention described herein includes a mechanical linkage and an extension module, such as a hydraulic piston, that are used in cooperation with one another to straighten a propeller drive shaft without the necessity to remove it from the lower unit/drive assembly. The linkage is configured to receive the propeller drive shaft at one end and to securely grip it in a desired orientation. One end of the extension module is placed on a footpiece coupled to the linkage at a point that is spaced apart from the propeller drive shaft. The other end of the extension module is placed against the bottom surface of the lower unit/drive assembly, which typically is the bottom surface of the cavitation plate. When activated, the extension module exerts a force against the bottom surface of the cavitation plate of the lower unit/drive assembly and the footpiece.

Because the cavitation plate is an integral part of the lower unit/drive assembly and is therefore stationary, the entire force is applied to the footpiece. The linkage is designed to receive the linear force from the extension module and to transfer this force to the bent propeller drive shaft. Because the propeller drive shaft is secured within both the linkage and the lower unit/drive assembly, when the force is applied to the propeller drive shaft, it acts to bend the propeller drive shaft in the direction of the force. Thus, when the propeller drive shaft is properly oriented, the bend in the propeller drive shaft can be eliminated or at least reduced to a specified tolerance.

As used herein the lower unit/drive assembly of an outboard motor or stern drive motor is considered to be the lower portion of the outboard motor or stern drive motor that includes the propeller shaft, gear box, and cavitation plate among other components. However, the present invention acts upon the external portion of the propeller shaft of these units. Thus, although the present invention is described in terms of a lower unit/drive assembly of an outboard or stern drive motor it is clear that the present invention may be used on an external portion of an inboard propeller shaft as well. Accordingly, as used herein, the term lower unit/drive assembly also should be read to include an inboard motor propeller shaft as well. In this case, the extension module is placed between the footpiece of the linkage and the bottom surface of the boat.

In the description that follows, it should be noted that the present invention does not require the outboard motor or stern drive to be disassembled, only the propeller must be removed. As such, the present invention may be used to straighten a propeller shaft either while the outboard motor, or drive unit of a stern drive is attached to the boat, or after the lower unit/drive assembly has been removed, or in the case of an outboard motor, the entire motor may be removed as well. If an inboard motor propeller shaft is being straightened, there is no need to disassemble and remove the propeller shaft from the boat.

In general, the linkage is configured to transfer the force in a downward direction substantially parallel to the longitudinal axis of the linkage. To properly orient the propeller drive shaft, a dial indicator is disposed at the bottom of the propeller drive shaft and measures the variation in the circumference of the propeller drive shaft. The point of maximum variation is located and the propeller drive shaft is oriented with this point being at the bottom of the propeller drive shaft. In this way, when the downward force is applied to the bent propeller drive shaft, the bend is not only in the plane in which the force is applied, but the propeller drive shaft is oriented in order to be bent in the opposite direction of the existing bend.

Figure 3:
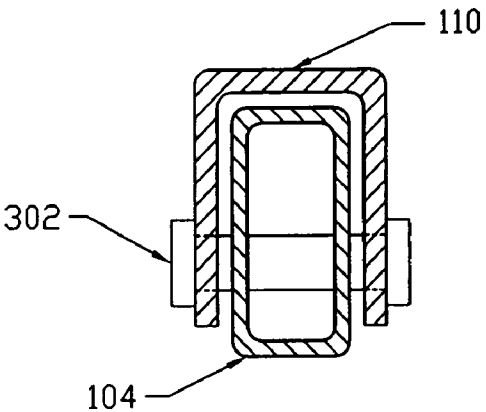
FIG. 3 is a view taken along axis III of FIG. 1.
Figure 2:
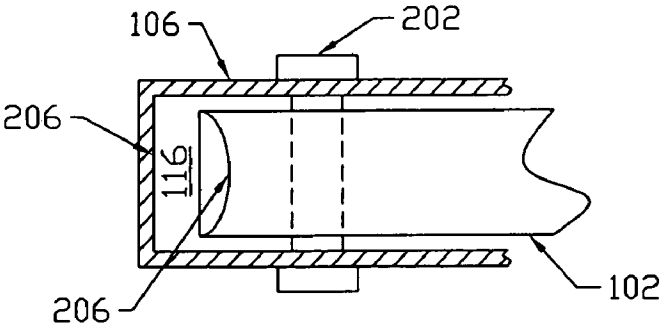
FIG. 2 is a view taken along axis II of FIG. 1.

In particular, FIG. 1 depicts a side view of an embodiment of a linkage 100 that is suitable for use in the present invention. The linkage 100 includes a link member 102 that has an upper portion 104, a headpiece 106 coupled to the upper portion 104, a lower portion 108, and a footpiece 110 that is coupled to the lower portion 108. As depicted in FIG. 2, the headpiece 106 is coupled to the link member 102 using a fastener 202 extending through bore 112. As depicted in FIG. 3, the footpiece 110 is coupled to the link member 102 using a fastener 302 extending through bore 114. There can be a plurality of bores 114 to accommodate engines of different sizes and extension modules having different lengths. In the illustrative embodiments, the headpiece 106 and footpiece 110 are rotatably coupled to the link member 102, but may be more rigidly attached as well.

Referencing FIG. 2, the headpiece 106 is an inverted U-shaped piece that is fitted over the end of the link 102 such that an opening 116 is formed between the lower surface of the headpiece 106 and the upper surface of the of link 102. The opening 116 is sized to receive a bent propeller drive shaft. In the illustrated embodiment, the upper surface of link 102 forms a lower gripping surface 204 and the lower surface of the headpiece forms an upper gripping surface 206. The two gripping surfaces 204, 206 are operative to securely grip a propeller drive shaft within the opening 116 and to maintain the orientation of the propeller drive shaft as the straightening force is applied thereto. In addition as depicted in FIG. 1, the headpiece 106 may have an angled portion 118 that, as will be explained in more detail below, allows the extension module to be placed closer to the lower unit/drive assembly.

Referencing now FIG. 3, the footpiece 110 is also a U-shaped piece that is configured to provide a platform on which the extension module is disposed. As discussed in more detail below, the footpiece receives the force from the extension module, and being coupled to the link member, transfers this force thereto.

Figure 4:
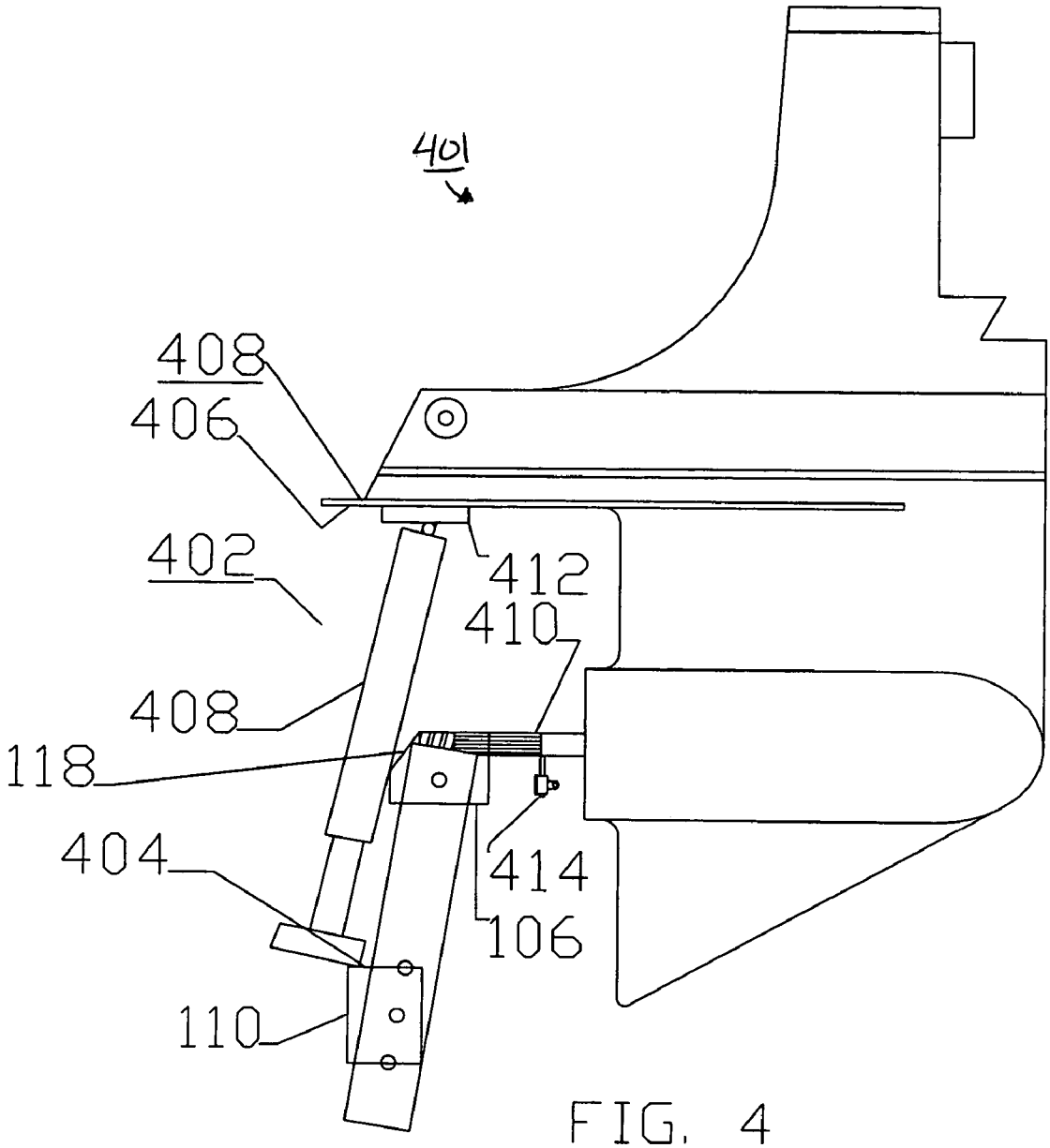
FIG. 4 is a side view of an embodiment of the linkage and extension module of the present invention in an operative configuration.

FIG. 4 depicts the linkage 100 from FIGS. 1–3 and an extension module 402 together in an operative configuration with a lower unit/drive assembly 401. The extension module 402 is placed between the upper surface 402 of the footpiece 110 and the lower surface 406 of the cavitation plate 408. As will be explained below, the propeller drive shaft 410 is oriented such that the largest variation in circumference is at the lowest point of the shaft. The lower gripping surface 204 and the upper gripping surface 206 cooperate to securely grip the propeller drive shaft 410 within the opening 116. As the extension module 402 is activated, the ram 412 is extended. This exerts a force against the bottom surface 406 of cavitation plate 408 and the upper surface 404 of footpiece 110. The footpiece transfers the force from extension module 402 to link 102. To exert the most force on the propeller drive shaft, the footpiece 110 and the extension module 402 should be oriented such that the extension module 402 and the link 102 are substantially parallel to one another. The angle portion 118 can facilitate the placement of the extension module in order to maintain the substantially parallel orientation of the extension module 402 and the link member 102. In this way, the link 102 is configured to transfer the majority of the linear force provided by the extension module 402 into a force that is applied to the propeller drive shaft 410 via the gripping surfaces 204, 206. Because the propeller drive shaft 402 is fixed within the lower unit/drive assembly, the force that is applied is translated into a force that is applied to bend the propeller drive shaft 410 in the direction of the force.

A consideration in the operation of the embodiments described herein is the orientation of the propeller drive shaft. To avoid bending the propeller drive shaft in an incorrect direction, the propeller drive shaft is oriented such that the largest variation in the circumference of the propeller drive shaft 410 is the lowest point of the propeller drive shaft 410. To accomplish this, a dial indicator 414 is disposed along the bottom surface of the propeller drive shaft 402 to measure the deviation from true of the propeller drive shaft. When the maximum deviation of the propeller drive shaft circumference is sensed by the dial indicator, the propeller drive shaft is placed into the opening 112 and secured between the gripping surfaces 204, 206. In this way, the proper orientation of the propeller drive shaft 410 is maintained.

In one method of straightening a bent propeller drive shaft, after the propeller drive shaft 410 is properly oriented and secured within the gripping surfaces 204, 206 the dial indicator is removed prior to the extension module being activated and released. The amount of time that the force is applied to the propeller drive shaft 410 is a function of the amount of force provided by the extension module 402 and the size of the bend in the propeller drive shaft. After the force has been applied for the desired time, the extension module 402 is then released, and the propeller drive shaft is again measured using the dial indicator. If the propeller drive shaft is not within the predetermined tolerance, the propeller drive shaft is again oriented such that the portion having the maximum deviation is at the bottom, the propeller drive shaft is secured between the two gripping surfaces 204, 206, and the process of activating the extension module 402 is repeated. In this way, the propeller drive shaft can be straightened without the need to remove it from the lower unit/drive assembly. In general, the propeller drive shaft must be bent beyond true in order to allow the shaft to return to true after the force applied to it is released.

In another embodiment, the dial indicator is used to constantly monitor the deviation of the propeller drive shaft. In this embodiment, care must be taken not to damage the dial indicator when applying the straightening force to the bent propeller drive shaft. Again, the amount of force can be determined by the amount of bend in the propeller drive shaft and by monitoring the dial indicator. As above, the shaft must be bent beyond true so that it can return to true after the force is released.

In one embodiment, the link member is a 12" long 1"×2" square tube of ⅛" thick mild steel. The link member has a pair of axially aligned bores centered and 1" from the top surface of the link member and 3 pair of centered axially aligned bores 2", 3.5", and 5" from the bottom surface of the link member. Each of the bore holes are 7/16" diameter. The headpiece is a U-shaped piece of 3/16" mild steel that is 3"×2" and has a pair of axially aligned ½" diameter bore holes centered and 2" from the closed end of the headpiece. The headpiece may have a flat head, or as depicted in FIG. 2, the headpiece may have a top surface that is an arcuate shape. The footpiece is a 3/16" piece of mild steel that is 3"×2" long and has a pair of axially aligned bores centered and 2" from the closed end of the footpiece. A 2¾" 7/16" coarse bolt and nut are used to fasten the headpiece to the link member, and a 2¾" 7/16" pin with clip is used to fasten the footpiece to the link member.

The extension module can be a hydraulic device such as a 4-ton or 10-ton porta-power hydraulic ram. Alternatively, the extension module can be a pneumatic device using air pressure to drive a ram or a mechanical device such as a mechanical jack.

Although in the illustrative embodiments depicted herein the gripping surfaces 204, 206 are formed by the top surface of the link member 102 and the bottom surface of the headpiece 106 other forms of gripping mechanisms may be used. For example and without limitation, the gripping surfaces may be a pair of gripping arms that are attached to the link member and can be locked into place to securely hold the bent propeller drive shaft and maintain the proper orientation of the propeller drive shaft during the straightening operation. In addition, although the footpiece is depicted as being rotatably coupled to the link member, the footpiece may also be rigidly attached to the link member. Moreover, although the lower gripping surface 204 is shown as being a square end of the link member, the lower gripping surface may also be an angled surface 105 as shown in FIG. 1.

It should be appreciated that other variations to and modifications of the above-described method and system for transferring and compressing medical image data may be made without departing from the inventive concepts described herein. Accordingly, the invention should not be viewed as limited except by the scope and spirit of the appended claims.

What is claimed is:

1. An apparatus for straightening a propeller drive shaft installed in a lower unit/drive assembly, the apparatus comprising:

a linkage configured to securely grip the bent propeller drive shaft;

an extension module having a first end disposed against a portion of the lower unit/drive assembly and a second end disposed against a portion of the linkage, wherein the extension module is configured to exert a force against a portion of the lower unit/drive assembly and against a portion of the linkage, wherein the linkage is configured to receive the second end of the extension module and to transfer the force to the bent propeller drive shaft with the linkage securely gripping the propeller drive shaft, and wherein the propeller drive shaft is bent in the direction of the force.

2. The apparatus of claim 1, wherein the linkage includes:

a link member having an upper portion and a lower portion;

a headpiece coupled to the upper portion of the link member; and a footpiece coupled to the lower portion of the link member.

3. The apparatus of claim 2 wherein the linkage further comprises:

an opening defined between a lower surface of the headpiece and an upper surface of the link member, wherein the lower surface of the headpiece forms an upper gripping surface and the upper surface of the link member forms a lower gripping surface, and wherein the propeller drive shaft is secured between the upper and lower gripping surfaces.

4. The apparatus of claim 2, wherein the headpiece is an inverted U-shaped piece that is disposed over an end of the link member, the headpiece and link member each having a pair of axially aligned bores and wherein the headpiece is oriented such that the bores of the headpiece are axially aligned with the bores of the link member and wherein the headpiece is coupled to the link member via a fastener extending through the axially aligned bores.

5. The apparatus of claim 4, wherein the headpiece is rotatably coupled to the link member via the fastener.

6. The apparatus of claim 2 wherein the footpiece is a U-shaped piece that includes a pair of axially aligned bores, and wherein the link member includes a pair of axially aligned bores, and wherein the footpiece is coupled to the link member via a fastener extending through the axially aligned bores, and wherein the footpiece has an upper surface configured to receive the extension module thereon.

7. The apparatus of claim 6, wherein the footpiece is rotatably coupled to the link member via the fastener.

8. The apparatus of claim 2 wherein the headpiece has an arcuate upper portion.

9. The apparatus of claim 1, further comprising a dial indicator disposed at the bottom of the propeller drive shaft and operative to sense the variation in the circumference of the propeller drive shaft.

10. The apparatus of claim 9, wherein the propeller drive shaft is securely gripped within the link member oriented such that the point of greatest variation of the propeller drive shaft is located at the bottom of the propeller shaft.

11. The apparatus of claim 1, wherein the extension module is a hydraulic ram.

12. The apparatus of claim 1, wherein the extension module is a pneumatic ram.

13. The apparatus of claim 1, wherein the extension module is a mechanical jack.

14. The apparatus of claim 1, wherein the portion of the lower unit/drive assembly pushed against by the extension module is the lower surface of the cavitation plate of the lower unit/drive assembly.

15. The apparatus of claim 1, wherein the portion of the lower unit/drive assembly pushed against by the extension module is the lower surface of the boat.

* * * * *